US007334362B2

(12) United States Patent
Bladt

(10) Patent No.: US 7,334,362 B2
(45) Date of Patent: Feb. 26, 2008

(54) READ-OUT DEVICE AND PROCEDURE FOR ITS MANUFACTURE

(75) Inventor: Henrik Henriksen Bladt, Vinderup (DK)

(73) Assignee: Bang & Olufsen A/S, Struer (DK)

( * ) Notice: Subject to any disclaimer, the term of this patent is extended or adjusted under 35 U.S.C. 154(b) by 726 days.

(21) Appl. No.: 10/487,217

(22) PCT Filed: Sep. 2, 2002

(86) PCT No.: PCT/DK02/00571

§ 371 (c)(1),
(2), (4) Date: Feb. 19, 2004

(87) PCT Pub. No.: WO03/019505

PCT Pub. Date: Mar. 6, 2003

(65) Prior Publication Data

US 2004/0247935 A1 Dec. 9, 2004

(30) Foreign Application Priority Data

Aug. 31, 2001 (DK) ..... 2001 01287

(51) Int. Cl.
*G09F 13/00* (2006.01)

(52) U.S. Cl. ..... 40/541

(58) Field of Classification Search ..... 40/541, 40/546, 564, 565, 566, 567, 568, 570, 571, 40/572, 573, 574, 575; 362/235–237, 248
See application file for complete search history.

(56) References Cited

U.S. PATENT DOCUMENTS 2,223,409 A * 12/1940 Dixon ..... 40/546
2,945,313 A * 7/1960 Hardesty ..... 40/546
4,417,411 A 11/1983 Miyagishima et al.
5,249,104 A * 9/1993 Mizobe ..... 362/605
5,987,793 A 11/1999 Ebine
6,101,748 A * 8/2000 Cass et al. ..... 40/219
6,160,495 A * 12/2000 Demink et al. ..... 340/944
6,443,593 B1 * 9/2002 Lauschner ..... 362/239
6,594,926 B1 * 7/2003 Wujciga ..... 40/200

FOREIGN PATENT DOCUMENTS

CN 1210324 A 3/1999

(Continued)

*Primary Examiner*—Christopher P. Ellis
*Assistant Examiner*—Shin Kim
(74) *Attorney, Agent, or Firm*—Harness, Dickey & Pierce, P.L.C.

(57) ABSTRACT

Displays for information exist, which appear to emerge out of a solid piece of metal. In order to obtain an aluminium-like and translucent material, according to prior art glass has aluminium vapour deposited onto the front surface, and a diode matrix display is hidden behind this translucent material while inactive, whereas it becomes visible when lit. In order to avoid the use of glass and to make the metal surface and the display surface indistinguishable from each other under all lighting conditions, the surface is made out of the piece of material constituting the surrounding parts. A cavity is formed from behind, and the bottom of said cavity is made very thin and hence translucent by etching or a similar material removing process. Oxide layers support this translucent layer, and an internal support is provided in the cavity, said support also carrying the sources of light.

15 Claims, 5 Drawing Sheets

FOREIGN PATENT DOCUMENTS

Figure 1:
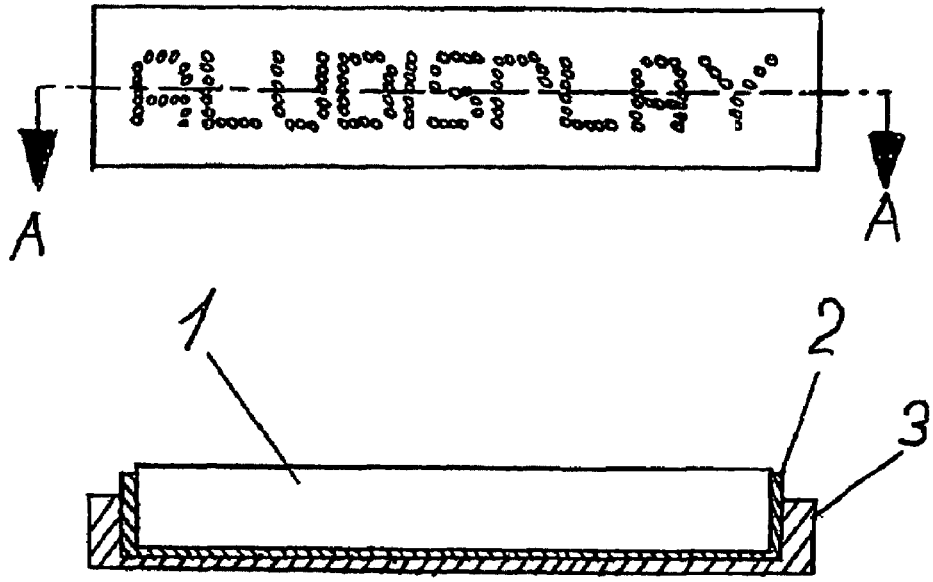

| | | | |
|---|---|---|---|
| DE | 29924202 | | 8/2002 |
| EP | 1211916 | A1 | 6/2002 |
| FR | 2702296 | | 9/1994 |
| GB | 2319796 | | 11/1984 |
| GB | 2226796 | | 7/1990 |
| JP | 7271309 | | 10/1995 |
| JP | 10228253 | | 8/1998 |
| JP | 2002023670 | | 1/2002 |
| JP | 2002040952 | | 2/2002 |

* cited by examiner

SECTION A-A

READ-OUT DEVICE AND PROCEDURE FOR ITS MANUFACTURE

The invention relates to a luminous character and symbol read-out device of a type which is integral with the surrounding surface.

Read-out devices are known, which appear as black fields which are activated by lighting up luminous units in a suitable pattern, which are hidden by the black-appearing field. Such a field may for instance be made in dark glass, through which shines the light from light emitting diodes, disposed in a suitable matrix. In the inactive state it is not apparent that any read-out device or display is present in the surface, and this may be used as a feature of industrial design in apparatus. Devices are known which are able to display characters on any surface, i.e. where there is no dependence on a black-appearing surface. This requires projection from a projector placed in front of the display, and this is not suitable for domestic apparatus. Furthermore various applications of glass plates as light guides are known, in which light falling on the edge may provide characters which may be read in the plane of the glass element. None of the constructions mentioned permits the use of e.g. a metallic surface, but as regards a piece of apparatus a glass surface is compulsory. There is, however, a desire to have the front of a piece of apparatus made in e.g. aluminium, which may be structured by brushing, but possibly also completely shiny.

In order to make a sheet of aluminium translucent it is necessary to drill holes, and a large number of closely disposed holes may provide a construction which under certain lighting conditions appears like an unbroken metal surface, where activation of a matrix of light-emitting diodes provides luminous characters. However, under certain other lighting conditions it is clearly to be seen that it is really a hole matrix, and the luminous characters may only be seen in a narrow angle around the axis, i.e. almost frontally. Furthermore the drilling creates local destruction of the protective oxide layer on the surface, and this refracts the light and makes the existence of a display field apparent. It has been recognised that aluminium which has been vapour deposited onto a transparent surface may be both translucent and appear to be completely metallic reflective, but use of these techniques again requires the presence of a glassy material, which must either be fitted into the surrounding aluminium surface or cover the whole surface, whereby the structural impression of solid aluminium is destroyed.

In practice, it is desirable to obtain the functionality of an apparently solid metallic but translucent surface with regard to many ferrous (such as a stainless steel alloy) or non-ferrous metals (such as aluminium, titanium, or zinc and their alloys). It is a purpose of the invention to provide a display device which is not subject to the above mentioned limitations in appearance. This is obtained in a construction, which is particular in that a cavity in the material is formed from the reverse side, which seen from the front surface and towards the rear comprises an outer protective transparent or translucent layer integral with, and identical with respect to visual appearance and touch to a protective layer for the surrounding surface, a translucent layer of the ferrous or non-ferrous metal, and a reinforcing structure for said layers, which provides access to sources of light for the display of information.

An embodiment of the invention is particular in that the outer protective transparent or translucent layer is a lacquer layer of a type which displays the hardness, toughness, and transparency expected of a metal lacquer adapted for the ferrous or non-ferrous metal in use. The actual choice of a lacquer, varnish, or enamel that fulfils such conditions is a well-known task for the skilled person working in the field of surface treatment of metals. The enamel may be vitreous for alloys and pure metals having a melting point above that of the enamel in question.

A further embodiment of the invention using aluminium is particular in that the bottom of the cavity seen from the front surface and towards the centre comprises an outer transparent oxide layer integral with the oxide layer of the surrounding surface, and a translucent layer of aluminium.

In a further embodiment of the invention the reinforcing structure for said layers additionally serves as a carrier for sources of light.

An advantageous embodiment of the invention is particular in that the reinforcing construction is made in a dimensionally stable casting compound, which supports the outer layers and carries a fixture for sources of light in order that the light is brought all the way to the outer layers. It is important that the casting compound displays neither shrinkage nor expansion during curing, because this would entail changes in the appearance of the front of the material which is to serve as a display area. The casting compound also must support the light sources in order that they are disposed as close as possible to the front.

In order to obtain as large a temperature stability in the construction as possible, materials of similar properties are used according to a further advantageous embodiment of the invention, in that the fixture is an element in the metal used for the blank of essentially the same but suitably reduced dimensions as the cavity, and in that the casting compound is translucent and fills the interstices between the metal element and the cavity.

According to a simplified construction, which also causes less local heating of the read-out device, the fixture holds the ends of optical fibres which carry light from more remote light sources.

According to a further simplified construction low power light emitting diodes are used close to the front surface functioning as a display area.

The invention also relates to a procedure for the manufacture of the read-out device, and it is particular in that it comprises at least the following steps, not necessarily in the order enumerated:

1) a cavity is formed in a blank, with a shape corresponding to the final cavity and a depth that leaves sufficient material that the protective layer on the front is not stressed, 2) a protective translucent or transparent layer is deposited on the front surface of the blank, 3) an etch-like process, such as a laser ablation or similar removal of material at an atomic level is performed on the bottom of the cavity, until a suitable translucency is obtained, 4) the remaining material in the bottom is protected against oxidation, 5) a reinforcing structure is placed in the cavity, 6) a compound is cast in the space left between the reinforcing structure and the cavity, 7) light sources are disposed in the reinforcing structure. In this method the actual process for the provision of the cavity is decided by the skilled person according to the material selected. For instance in some materials, it may be expedient to use milling, or turning, or grinding, whereas others would work well with the much faster operation of calibrated partial punching, in which the material flows. The forming of the cavity may occur before or after the surface texturing (which is to be regarded as separate from surface protection), which may take place by brushing, shot peening, or grinding. The creation of the cavity may be a multi-step process comprising electro-erosion. The skilled person will determine if all the part processes comprised in the method are suitable for a particular product.

In an advantageous method for use with a blank made of aluminium is particular in comprising the following steps, not necessarily in the order enumerated:

1) a cavity is milled in the blank, with a shape corresponding to the final cavity and a depth that leaves sufficient material that the oxide layer on the front is not stressed, 2) an etch-like process, such as a laser ablation or similar removal of material at an atomic level is performed on the bottom of the cavity, until a suitable translucency is obtained, 3) part of the remaining material in the bottom is converted electrolytically to aluminium oxide, 4) a fixture for the light sources is fitted into the cavity, 5) a compound is cast in the space left between the fixture and the cavity.

An advantageous method for controlled removal of material consists in subjecting the material to pulses from a high power laser, and as opposed to many other applications of this technology it is feasible to control the operation by measuring the translucency by means of an adaptive light sensor coupled to the control circuit of the laser from the front side of the aluminium blank, i.e. there is no dependence on the reflection from the material directly reached by the laser. Dependent on the wavelength of the ablating high power laser, it may be advantageous to use a separate light source for the measurement of the translucency, in particular a light source having the same wavelength distribution as the light source that will be incorporated in the display.

Figure 2:
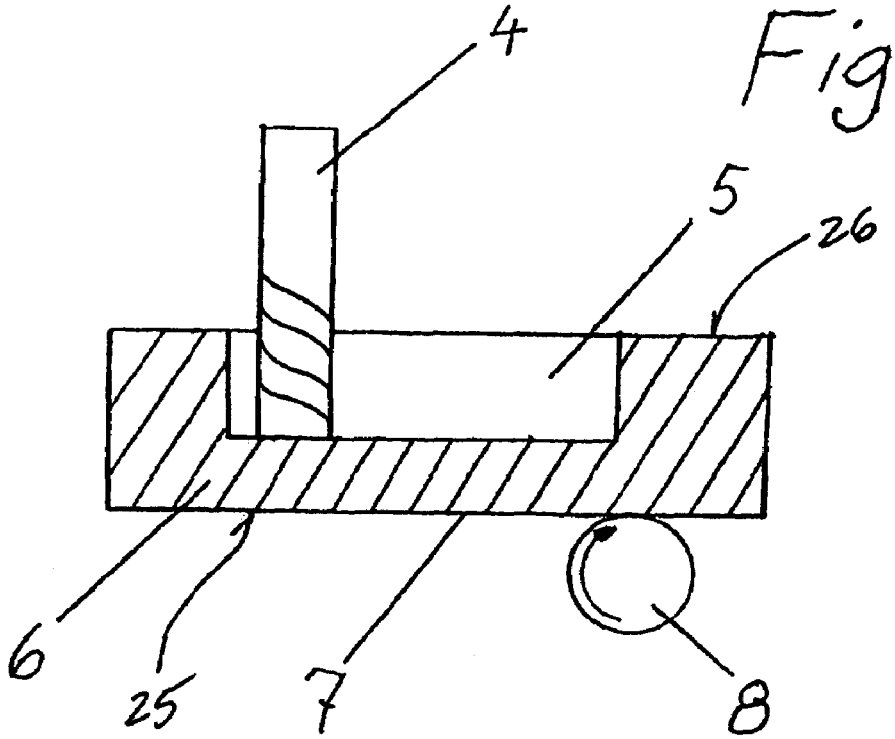
Figure 3:
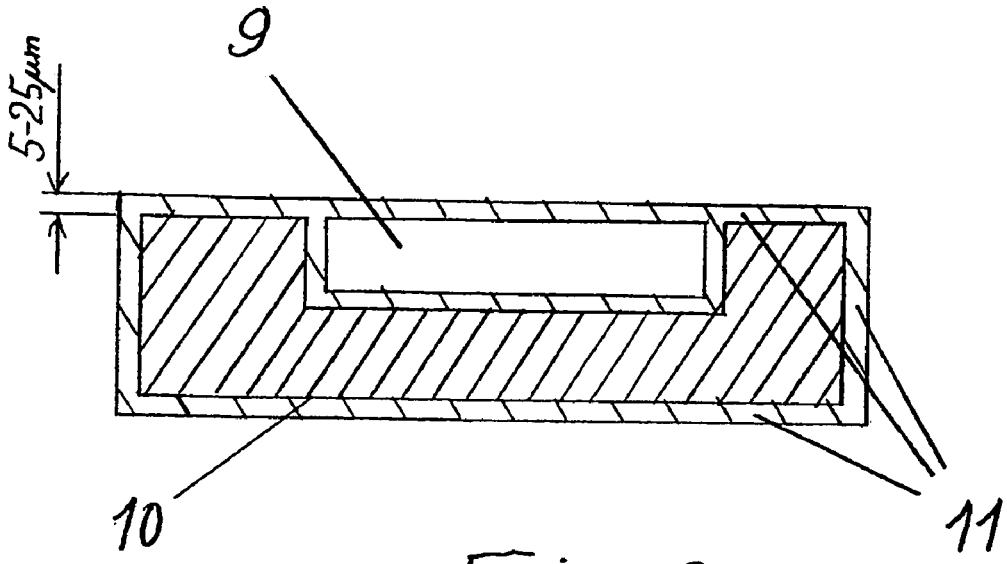
Figure 4:
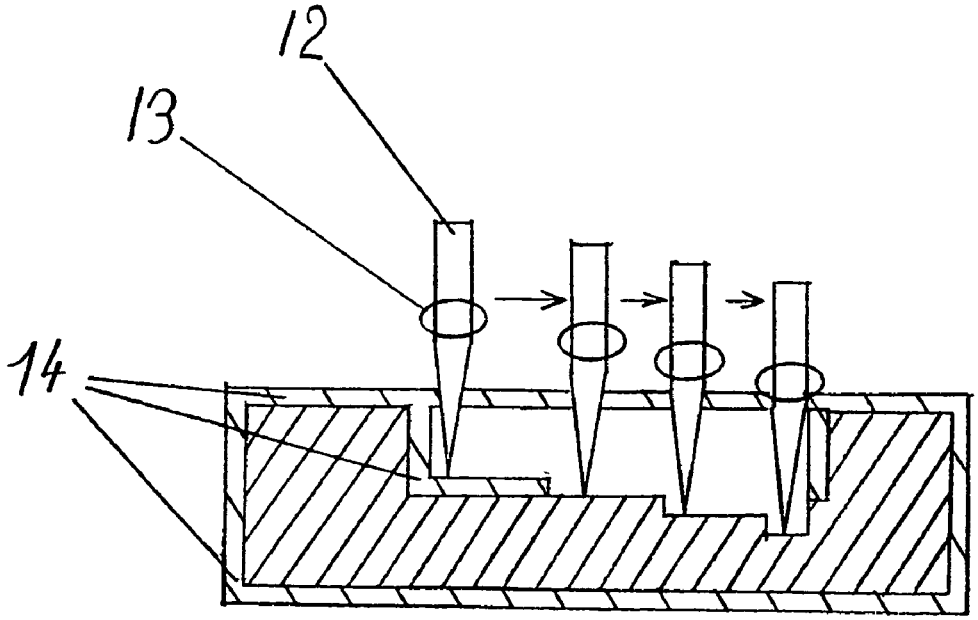
Figures 5, 6A, 6B:
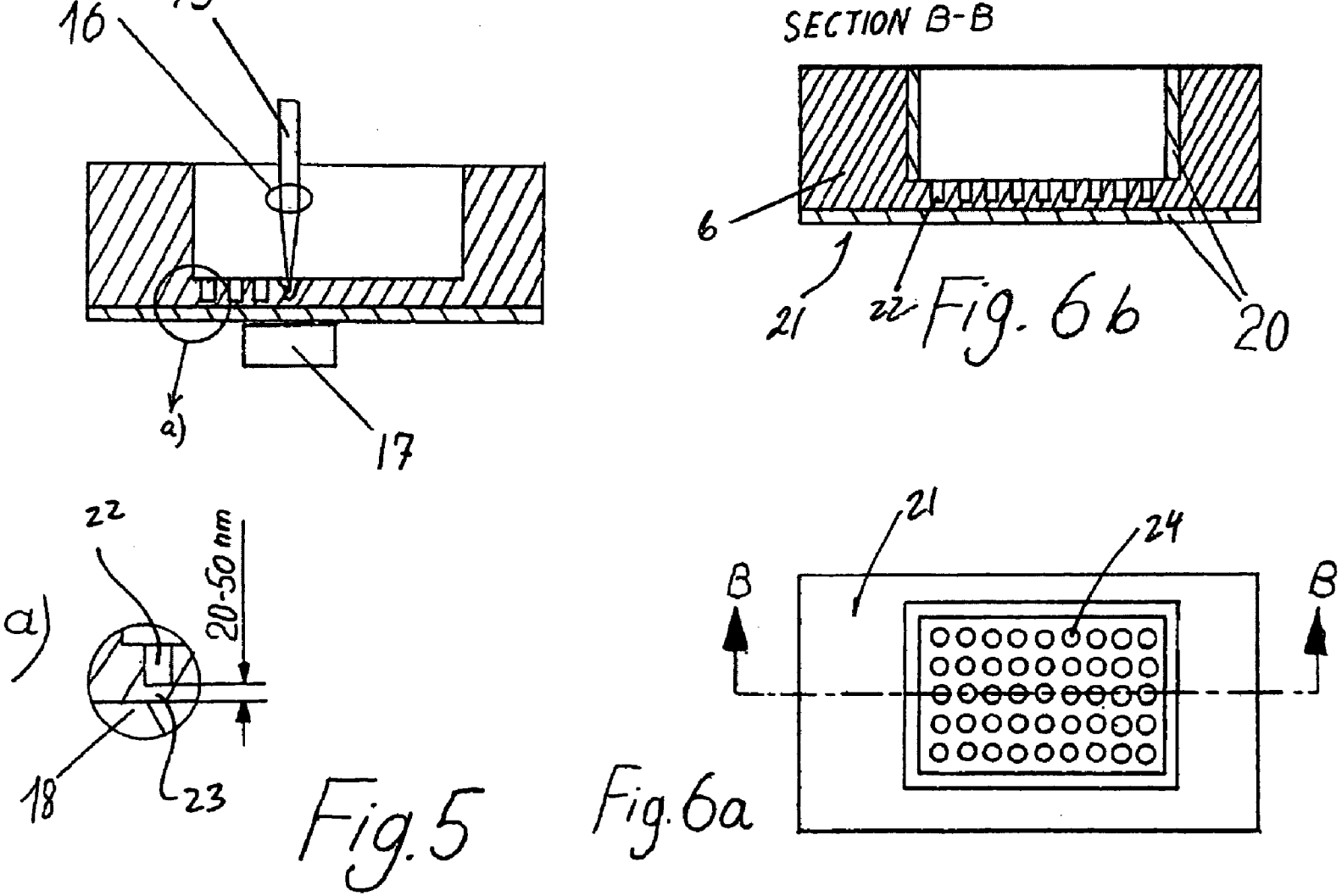
Figure 6C:
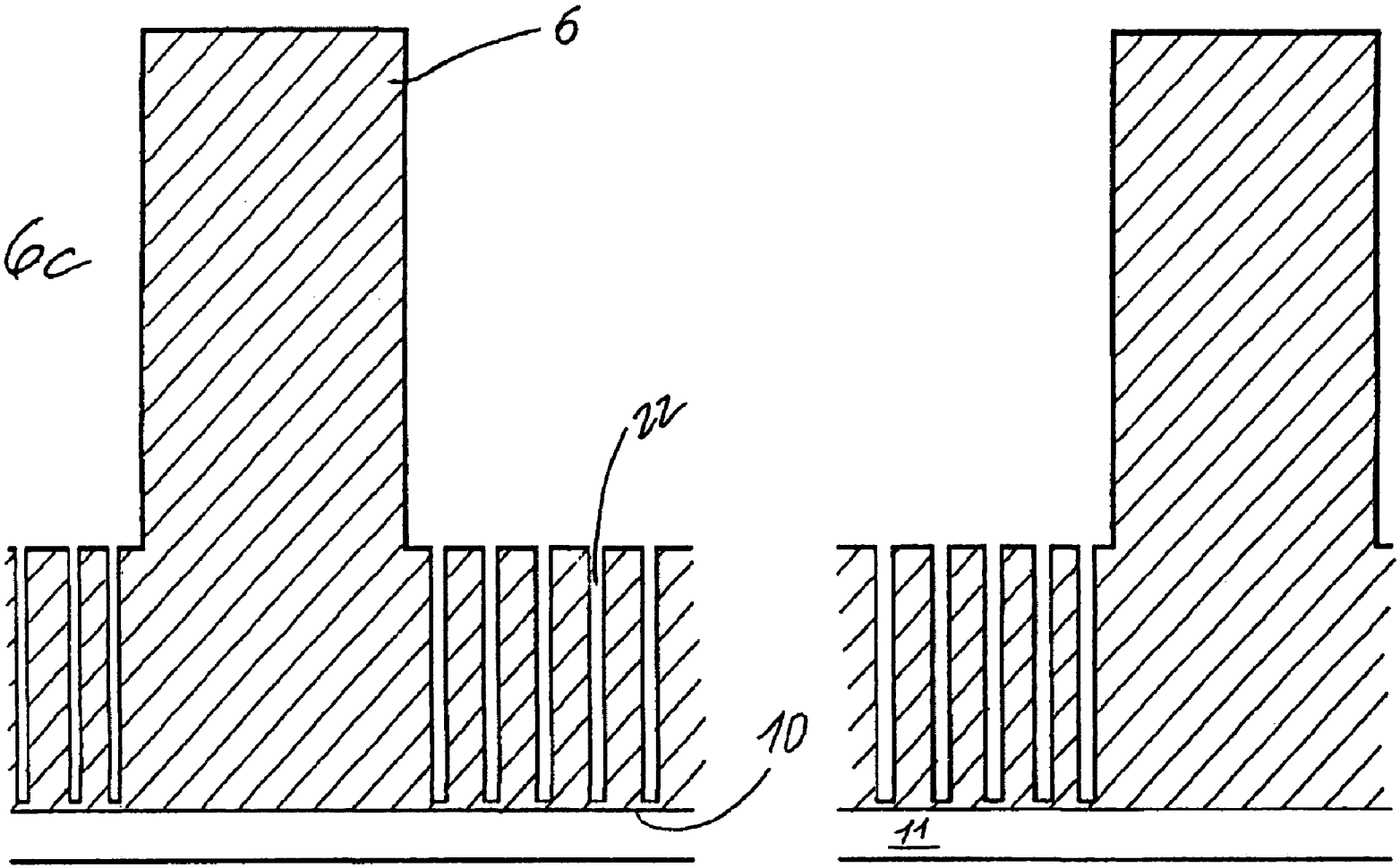
Figure 7:
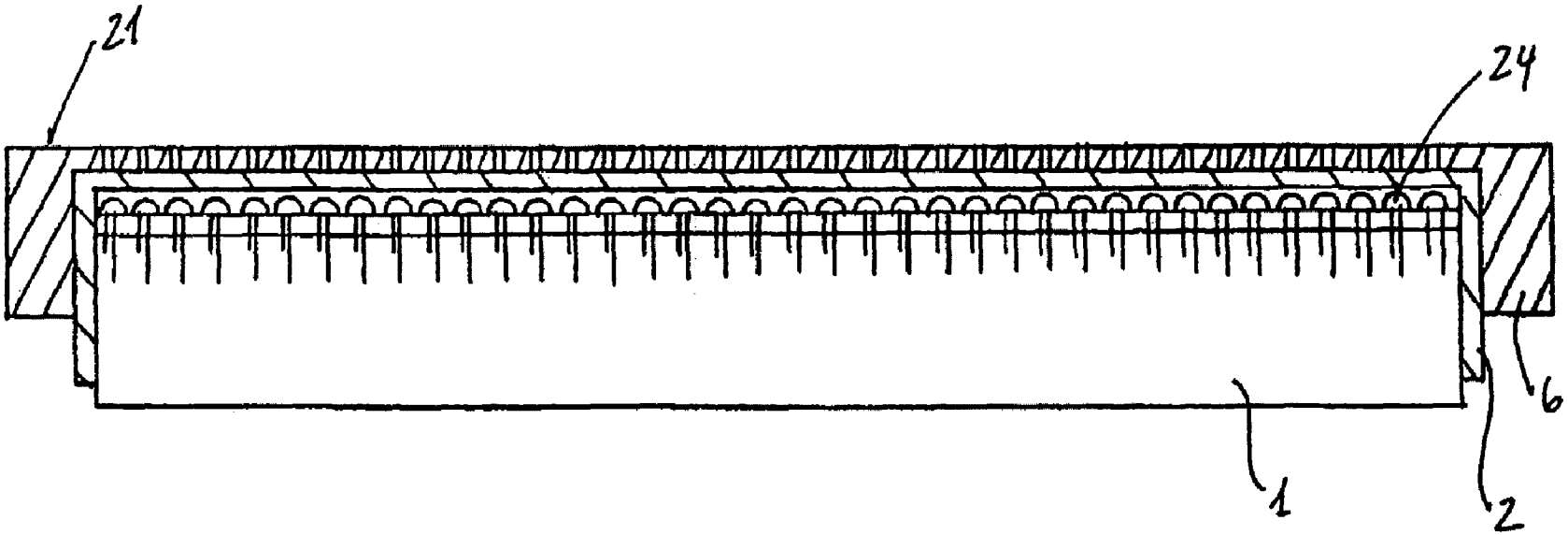

The invention will be described in detail with reference to the drawing, in which FIG. 1 shows the appearance of a display according to the invention, FIG. 2 shows a blank in the first stage of manufacture, FIG. 3 shows the result of a further stage of manufacture, FIG. 4 shows a further stage of manufacture, FIG. 5 shows a still further stage of manufacture and the precision worked to, FIGS. 6*a* and 6*b* show two views of a finished cavity for a display device according to the invention, FIG. 6*c* shows the same in greater detail, and FIG. 7 shows a cavity fitted with a fixture for light sources.

In FIG. 1 is shown the structure of a display device according to the invention. An aluminium plate 3 with an appropriate surface finish is provided with a cavity into which is cast a casting compound 2 surrounding a light source fixture element 1. At a) is shown the appearance of the display device when lit in a pattern that reads ALUDISPLAY. The dimension of the circles used to indicate the dot matrix pattern is not indicative of the dimension of each point of light but of its perceived brightness. When the display device is switched off, there is no perceptible difference between the display area and the surrounding surface 21, as shown in FIG. 6*b*, finish of the aluminium material.

In FIG. 2 is schematically shown how a milling cutter 4 prepares a cavity in the blank 6 from the rear surface 26 of the blank and it is also shown that the front surface 25 of the blank 6 is provided with a particular surface finish by the tool 8, which may be a grinding or polishing wheel or a wire brush or a shot peening operation. The order in which these mechanical operations are performed will be determined by the skilled person. The forces created by the cutting process determine the depth to which the milling may reach, because the test is that there must be no influence on the oxide layer on the front of the display device, i.e. no crazing of the oxide layer which would very clearly indicate the location of the display device.

Subsequent to this the blank with the pre-machined section 9 is subjected to decorative anodization or coating/lacquering with a transparent coat in order to protect the front surface before the final stages of manufacture. The intermediate result is shown schematically in FIG. 3 in which 11 indicates the anodized oxide layer which has a thickness of typically 5-25 μm, and 10 indicates the aluminium surface below.

In order to reduce the thickness of the aluminium in the display area without stressing the front oxide layer a stepwise removal of material is obtained by a process of laser ablation (the preferred process). In FIG. 4 this is schematically shown by the laser beam 12, the laser optics 13 and the various depths that the laser beam reaches. It will be noticed that the anodized oxide layer 14 on the bottom of the cavity is simultaneously removed (and to the extent that the process takes place in an oxidising atmosphere it is replaced by a thin layer of oxide).

In FIG. 5 is shown a schematic representation of the final process in the provision of the cavity 22 proper: in selected locations (dots distributed according to some rule or in a raster) a high power laser, such as a femto-second laser is used to "drill" holes to within 10-30 nm of the front surface (the transfer from metallic aluminium to decorative oxide). The drilling is monitored by means of the light sensor 17 which provides an input signal to the control of the power and/or the depth of the laser 15, 16. At a) is shown in enlarged detail that a very thin layer of translucent aluminium 23 remains in the bottom of each hole or vacuum deposited aluminium layer on the transparent oxide layer. It may advantageous to remove almost all the aluminium in a pre-defined pattern, because that will give a slightly "floating" visibility of that pattern in ordinary lighting, whereas the pattern may either be reinforced by being lit as described in the present application, or the pattern may be extinguished by a different pattern created by the sources of light.

In FIGS. 6*a* and 6*b* it is finally shown how the shell of the display device according to the invention appears after manufacture.

In FIG. 7 is shown how a fixture for a number of individually addressable light sources 24 is fitted and held in a cavity until a casting compound has cured around it, whereupon the display device as such is ready to use. The finished display device supports the front oxide layer fully, and the thermal coefficient of expansion is such that this is obtained in a very wide temperature range. Provided the thermal capacity of the fixture is similar to aluminium, the surface at the display area is indistinguishable from solid aluminium, even to the touch.

The invention will be further documented by means of the following

EXAMPLE

A thin sheet of 10 mm diameter was prepared in a piece of aluminum by turning on a lathe to a thickness of 100 μm. This was subsequently anodized to a thickness of 15 μm of the oxide layer on either side. This semi-product was exposed to the ablative laser treatment according to one aspect of the invention performed at Laser-Laboratorium Göttingen e.V., P.O. Box 2619, D-37016 Göttingen, Germany. A number of square "dots" 1 mm×1 mm were formed in the prepared thin sheet, until a translucency of 0.1% was obtained for each "dot". Each dot consists of a grid of 10×10 essentially cylindrical (but in practice slightly conical) microcavities each 40 μm in diameter and a centre-to-centre distance of 100 μm. Closer inspection of a cavity displays a slightly edgy cross section. A UV-Excimer femtosecond laser was used, and a CCD camera was used on the side of the sheet not being treated in order to determine when the appropriate translucency for any one microcavity had been obtained, whereupon the laser beam was stopped and moved to the next location in the grid. In some cases, the final transparency of individual microcavities was considerably higher, because of a depletion of aluminium due to surface roughness. However visual inspection of the front of finished articles, even under a microscope (×100 magnification) and angled illumination from the side did not reveal the location of these spots of higher transparency, and they are hence considered to be insignificant in a practical product. FIG. 6*c*, which is not to scale, shows the layout of the microcavities and the strengthening ribs in the structure at the bottom of the cavity.

A light-emitting diode was fitted in the cavity on one side of the thin sheet, and the other side—the front—was observed both in daylight and in the dark. The dot pattern was clearly visible as emanating from the solid aluminium surface in a viewing angle of 120°, and in broad daylight a red light was clearly visible at a distance of maximum 3-4 m. A blue diode was less visible, the maximum distance being only 1 m. When the LED was turned off, there was no visible trace of the laser ablation treatment on the front surface which appeared totally uniform, even when a hand-held magnifier was used.

It falls within the scope of the invention to provide an apparently solid but translucent display of various types, such as a dot matrix display, a static text or symbol display, or a dynamic text or symbol display. The choice of type may influence the actual shape of the translucent parts, in that the bottom of the cavity may be predominantly smooth and translucent (providing apparent infinite resolution in the characters or symbols displayed) or predominantly made up of translucent islands surrounded by a gridlike structure or ribs of the metal (for instance corresponding to a dot-matrix type display). Such a gridlike structure only visible on the reverse side of the display provides a re-enforcement of the structure and improves the joint between inserts and the metal part.

The invention claimed is:

1. A luminous character and symbol read-out device wherein the read-out device is integrated in a metal blank, where said blank has a front surface and a rear surface and a material thickness therebetween, where said blank is of a type where the read-out device is integral with a surrounding surface of said blank, and where the blank is a ferrous or non-ferrous metal, wherein a cavity in the blank is formed from the rear surface, said read-out device when seen from the front surface and towards the rear surface comprises an outer protective transparent or translucent layer integral with, and identical with respect to visual appearance and touch to a protective layer for the surrounding surface of said blank, a translucent layer of the ferrous or non-ferrous metal, and a reinforcing structure for said layers, which provides access to sources of light for a display of information.

2. A read-out device according to claim 1, wherein the outer protective transparent or translucent layer is a lacquer layer of a type which displays a hardness, toughness, and transparency expected of a metal lacquer adapted for the ferrous or non-ferrous metal in use.

3. A read-out device according to claim 1, wherein the outer protective transparent or translucent layer is a vitreous enamel or a ceramic.

4. A read-out device according to claim 1, wherein the outer protective transparent or translucent layer is an oxide of a type obtained by anodization.

5. A read-out device according to claim 4 in which the metal blank is aluminium, and a bottom of the cavity seen from the front surface and towards the rear surface comprises an outer transparent oxide layer integral with an oxide layer of the surrounding surface, and a translucent layer of aluminium.

6. A read-out device according to claim 1, wherein part of the translucent layer of the ferrous or non-ferrous metal is essentially transparent in a predetermined pattern.

7. A read-out device according to claim 1, wherein the reinforcing structure for said layers additionally serves as a carrier for sources of light.

8. A read-out device according to claim 1, wherein the reinforcing structure is made in a dimensionally stable casting compound, which supports said layers and carries a fixture for sources of light in order that light is brought all the way to said layers.

9. A read-out device according to claim 8, wherein the fixture is an element in the metal blank of essentially the same but suitably reduced dimensions as the cavity, and in that the dimensionally stable casting compound is translucent and fills a plurality of interstices between the fixture and the cavity.

10. A read-out device according to claim 8, wherein further comprising a plurality of optical fibers, the optical fibers are used as light sources, each of the plurality of optical fibers has at least one end, the fixture holds the ends of said optical fibers, the optical fibers configured to transmit light from more remote light sources.

11. A read-out device according to claim 7, wherein low power light emitting diodes are used close to the front surface functioning as a display area.

12. A read-out device according to claim 1, wherein it is provided in a prominently visible outer part of a cabinet for electronic equipment.

13. A read-out device according to claim 12, wherein said prominently visible outer part of a cabinet is a structural element of said cabinet.

14. A process for manufacturing a read-out device, where said read-out device when seen from a front surface and towards a rear surface comprises an outer protective transparent or translucent layer integral with, and identical with respect to visual appearance and touch to a protective layer for a surrounding surface of a metal blank, wherein the process comprises the following steps: 1) forming a cavity in a blank where said blank has a front surface and a rear surface and a material thickness therebetween, the cavity having a depth that leaves sufficient material such that a material layer between a bottom of the cavity and said front surface is translucent, and further the depth leaves sufficient material in order that the protective layer on the front surface is not stressed, 2) depositing a protective translucent or transparent layer at least on the front surface of the blank, 3) performing an etch-like process, such as a laser ablation or similar removal of material at an atomic level on the bottom of the cavity, until a suitable translucency is obtained, 4) protecting material remaining in the bottom of the cavity against oxidation, 5) placing a reinforcing structure in the cavity, 6) casting a compound in a space left between the reinforcing structure and the cavity, 7) disposing light sources relative to the reinforcing structure.

15. A process for manufacturing a read-out device where said read-out device when seen from a front surface and towards a rear surface comprises an outer protective transparent or translucent layer integral with, and identical with respect to visual appearance and touch to a protective layer for a surrounding surface of a blank wherein the process comprises the following steps: 1) forming a cavity in an aluminum blank, where said blank has a front surface and a rear surface and a material thickness therebetween, the cavity having a depth that leaves sufficient material such that a material layer between a bottom of the cavity and said front surface is translucent, and further the depth leaves sufficient material that the an oxide layer on the front surface is not stressed, 2) performing an etch-like process, such as a laser ablation or similar removal of material at an atomic level on the bottom of the cavity, until a suitable translucency is obtained, 3) converting part of material remaining in the bottom of the cavity electrolytically to aluminium oxide, 4) fitting a fixture for a plurality of light sources into the cavity, 5) casting a compound in a space left between the fixture and the cavity.

* * * * *